United States Patent [19]

Vanier et al.

[11] Patent Number: 4,876,238

[45] Date of Patent: Oct. 24, 1989

[54] INCREASING DYE TRANSFER EFFICIENT IN DYE-DONOR ELEMENTS USED IN THERMAL DYE TRANSFER

[75] Inventors: Noel R. Vanier, Rochester; Kin K. Lum, Webster, both of N.Y.

[73] Assignee: Eastman Kodak Company, Rochester, N.Y.

[21] Appl. No.: 221,150

[22] Filed: Jul. 19, 1988

Related U.S. Application Data

[63] Continuation-in-part of Ser. No. 129,037, Dec. 4, 1987, abandoned.

[51] Int. Cl.[4] ..... B41M 5/035; B41M 5/26

[52] U.S. Cl. ..... 503/227; 8/411; 428/195; 428/480; 428/913; 428/914

[58] Field of Search ..... 8/470, 471; 427/146, 427/256; 428/195, 480, 913, 914; 430/200, 201, 945; 503/227

[56] References Cited

FOREIGN PATENT DOCUMENTS 132676 6/1987 Japan ..... 503/227

*Primary Examiner*—Bruce H. Hess

*Attorney, Agent, or Firm*—Harold E. Cole

[57] ABSTRACT

A dye-donor element for thermal dye transfer comprising a support having on one side thereof a dye dispersed in a polymeric binder, and wherein the dye-donor element contains a colorless, nonpolymeric material for increasing dye transfer efficiency having the following formula:

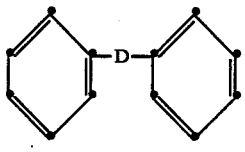

wherein D is —CO—, —$SO_2$NR—, —CONR—, —CO—CHR—CO—,

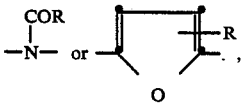

wherein R is H or a substituted or unsubstituted alkyl group having from 1 to about 6 carbon atoms.

20 Claims, No Drawings

INCREASING DYE TRANSFER EFFICIENT IN DYE-DONOR ELEMENTS USED IN THERMAL DYE TRANSFER

This application is a continuation-in-part of U.S. Application Serial Number 129,037 filed Dec. 4, 1987, now abandoned.

This invention relates to materials which can be added to a dye-donor element in order to improve the dye transfer efficiency.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Patent No. 4,621,271 by Brownstein entitled "Apparatus and Method For Controlling A Thermal Printer Apparatus," issued Nov. 4, 1986, the disclosure of which is hereby incorporated by reference.

It is always desirable to transfer as much dye as possible with the lowest thermal energy in dye transfer systems using a thermal head. The amount of dye which can be transferred from a dye-donor to a receiving element by thermal dye transfer depends upon the dye transfer efficiency. There are compounds which have been added to the dye-donor in order to increase the dye transfer efficiency which would enable a given amount of dye to be transferred with less energy. However, these compounds have suffered from one or more shortcomings. For example, some compounds which have been tried cause crystallization of the dye. Other compounds have a beneficial effect on dye transfer initially, but lose that effect upon storage of the dye-donor.

In JP 62/132,676, there is a disclosure of compounds described as "diffusion promoters". These compounds are coated in a blank frame or blank patch of a dye-donor element by themselves, separate from the dye patches.

There are problems with having such a diffusion-promoting material coated in a blank patch separate from the dye patch. Such a procedure would necessitate a separate heating step during processing in order to apply the material to the receiver. There would also be additional manufacturing costs involved in coating the material separately from the dye, as well as additional costs in the thermal transfer of such material.

It would be desirable to provide a way to employ a material to increase dye transfer efficiency without having to coat it separately from the dye layer. It would also be desirable to provide such a material which would not promote crystallization of the dye in the dye-donor and which would retain its beneficial effects upon storage.

These and other objects are achieved in accordance with this invention which comprises a dye-donor element for thermal dye transfer comprising a support having on one side thereof a dye dispersed in a polymeric binder, and wherein the dye-donor element contains a colorless, nonpolymeric material for increasing dye transfer efficiency having the following formula:

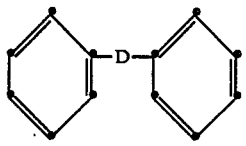

wherein D is —CO—, —$SO_2$NR—, —CONR—, —CO—CHR—CO—,

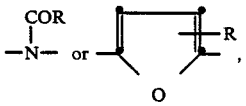

wherein R is H or a substituted or unsubstituted alkyl group having from 1 to about 10 carbon atoms, such as methyl, ethyl, propyl, isopropyl, butyl, pentyl, hexyl, methoxyethyl, benzyl, 2-cyanoethyl, methoxycarbonylmethyl, etc..

These compounds provide an increase in dye transfer efficiency by providing equivalent density with less energy than a dye-donor which does not contain the compounds.

The materials described above may be incorporated directly into the dye layer of the dye-donor or in an adjacent layer where it will be in effective contact with the dye. The material may be employed in any amount which is effective for the intended use. In general, good results have been obtained at a concentration of from about 0.05 to about 0.3 g/$m^2$ or about 30% to about 300% by weight of coated dye.

In a preferred embodiment of the invention, D in the above formula is —CO—CHR—CO—, wherein R is hydrogen. In another preferred embodiment, D is —$SO_2$NR—, wherein R is —$C_2H_5$. In still another preferred embodiment, D is —CONR—, wherein R is methyl or ethyl.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Weaver and Lum; 4,695,287 of Evans and Lum; and 4,701,439 of Weaver, Moore and Lum; and U.S. Application Ser. Nos. 059,442 of Byers and Chapman, filed June 8, 1987; 059,443 of Evans and Weber, filed June 8, 1987; 095,796 of Evans and Weber, filed Sept. 14, 1987; and 123,441 of Byers, Chapman and McManus, filed Nov. 20, 1987, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to illustrate the invention.

EXAMPLE 1

A magenta dye-donor element was prepared by coating on a 6 μm poly(ethylene terephthalate) support:

(1) a subbing layer of a titanium alkoxide (duPont Tyzor TBT ®) (0.12 g/m$^2$) coated from a n-propyl acetate and n-butyl alcohol solvent mixture, and (2) a dye layer containing the magenta dye illustrated above (0.17 g/m$^2$) in a cellulose acetate propionate binder (2.5% acetyl, 45% propionyl) (0.31 g/m$^2$) coated from a toluene, methanol and cyclopentanone solvent mixture, and the aromatic compound indicated in the Table (0.17 g/m$^2$).

On the back side of the dye-donor was coated:

(1) a subbing layer of a titanium alkoxide (duPont Tyzor TBT ®) (0.12 g/m$^2$) coated from a n-propyl acetate and n-butyl alcohol solvent mixture, and (2) a slipping layer containing the following material for Sets A and D: Emralon 329 ® (Acheson Colloids Corp.) dry film lubricant of poly(tetrafluoroethylene) particles in a cellulose nitrate resin binder (0.54 g/m$^2$), coated from a n-propyl acetate, toluene, isopropyl alcohol and n-butyl alcohol solvent mixture; For Set B, the same as Set A, but also containing Petrarch Systems PS513 ® amino-terminated polysiloxane (0.004 g/m$^2$); p-toluenesulfonic acid (2.5% of the wt. of the polysiloxane); and BYK-320 ® (BYK Chemie, USA) copolymer of a polyalkylene oxide and a methyl alkylsiloxane (0.008 g/m$^2$); For Set C, the same as Set A, but also containing S-232 ® wax (Shamrock Technologies) micronized blend of polyethylene and carnauba wax particles (0.016 g/m$^2$).

The dye-donors were then incubated for 7 days at 49° C., 50% RH.

A dye-receiver was prepared by obtaining a commercially produced paper stock 165 μm thick mixture of hard woodkraft and soft wood-sulfite bleached pulp. The paper stock was then extrusion overcoated with an approximately 1:4 ratio of medium density:high density polyethylene (12 g/m$^2$) with approximately 6 wt. percent titanium dioxide and 1.5 wt. percent zinc oxide. The support was then coated with the following layers:

(a) Subbing layer of poly(acrylonitrile)-covinylidene chloride-co-acrylic acid (14:79:7 wt. ratio) (0.54 g/m$^2$) coated from a butanone and cyclopentanone solvent mixture; and (b) Dye-receiving layer of Makrolon 5705 ® polycarbonate (Bayer AG) 2.9 g/m$^2$), 1,4-didecoxy-2,5-dimethoxybenzene (0.38 g/m$^2$), and FC-431 ® (3M Corp.) surfactant (0.016 g/m$^2$) coated from methylene chloride.

The dye side of the dye-donor element strip approximately 10 cm × 13 cm in area was placed in contact with the dye image-receiving layer of the dye-receiver element of the same area. The assemblage was clamped to a stepper-motor driven 60 mm diameter rubber roller and a TDK Thermal Head (No. L-231) (thermostated at 26° C.) was pressed with a force of 8.0 pounds (3.6 kg) against the dye-donor element side of the assemblage pushing it against the rubber roller.

The imaging electronics were activated causing the donor/receiver assemblage to be drawn between the printing head and roller at 6.9 mm/sec. Coincidentally, the resistive elements in the thermal print head were pulsed for 29 μsec/pulse at 128 μsec intervals during the 33 msec/dot printing time. Graduated density test images were generated using a "pulsed-imaging" technique as described in U.S. Pat. No. 4,621,271 of Brownstein referred to above. Pulses/dot were incrementally increased from 0 to 255. The voltage supplied to the print head was approximately 23.5 volts, resulting in an instantaneous peak power of 1.3 watts/dot and a maximum total energy of 9.6 mjoules/dot.

The dye-receiver was separated from the dye-donor and the Status A green densities of each transferred image consisting of a series of eleven graduated density steps one cm square were read, and the maximum density, D-max, was tabulated. The energy (number of pulses) required to produce a density of 2.0 was also calculated. In this manner, the relative efficiency of thermal dye transfer (pulses for 2.0 density) can be effectively compared.

In general, materials suitable for the practice of the invention had to produce a 2.0 density after donor incubation with at least 5% less energy (approximately 12–15 pulses less) and not show a maximum density loss greater than 0.5 as compared to a control with no material added. The following results were obtained.

TABLE

| | Compound | | | Pulses/D = 2.0 Obs. | Δ Cont. | Dmax Obs. | Δ Cont. |
|---|---|---|---|---|---|---|---|
| Set Comparison | | | | | | | |
| A | None (control) | | | 211 | — | 3.0 | — |
| A | Benzamide | | | 202 | −9 | 3.0 | 0 |
| A | p-Toluamide | | | 204 | −7 | 3.2 | +0.2 |
| A | Phenyl benzoate | | | 209 | −2 | 2.1 | −0.9 |
| A | p-Toluenesulfonamide | | | 228 | +17 | 2.0 | −1.0 |
| | D | R | $R_1$ | | | | |
| Invention | | | | | | | |
| A | $-CO-CH_2-CO-$ | H | H | 187 | −24 | 3.2 | +0.2 |
| A | 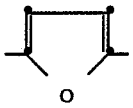 | H | H | 189 | −22 | 3.3 | +0.3 |
| A | $-CO-$ | H | H | 190 | −21 | 2.9 | −0.1 |
| Set | | | | | | | |
| B | None(control) | — | — | 230 | — | 2.8 | — |
| Invention | | | | | | | |
| B | $-SO_2N(C_2H_5)-$ | $2\text{-}N(C_2H_5)(SO_2C_6H_5)$ | H | 216 | −14 | 2.9 | +0.1 |
| B | $-SO_2N(C_2H_5)-$ | H | H | 213 | −17 | 2.9 | +0.1 |
| B | $-CO-$ | $[2\text{-}COC_6H_4-(4\text{-}CH_3)]$ $(4,5\text{-}CH_3)$ | $4'\text{-}CH_3$ | 214 | −16 | 2.9 | +0.1 |
| Set | | | | | | | |
| C | None (control) | — | — | 236 | — | 2.5 | — |
| C | $-CON(CH_3)-$ | $4\text{-}O_2CC_2H_5$ | $4'\text{-}OCH_3$ | 199 | −37 | 3.0 | +0.5 |
| C | $-CON(CH_3)-$ | $3\text{-}CH_3$ | H | 213 | −23 | 2.9 | +0.4 |
| D | None (control) | — | — | 219 | — | 3.0 | — |
| D | $-CON(CH_3)-$ | $2\text{-}CON(CH_3)(C_6H_5)$ | H | 197 | −22 | 3.3 | +0.3 |
| D | $-CON(C_2H_5)-$ | $2\text{-}CON(C_2H_5)(C_6H_5)$ | H | 206 | −13 | 3.2 | +0.2 |

The above results indicate that materials used in accordance with the invention produced at least a 2.0 density after donor incubation, with at least 5% less energy (approximately 12–15 pulses less), without showing a maximum density loss greater than 0.5 as compared to a control with no material added.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having on one side thereof a dye dispersed in a polymeric binder, the improvement wherein said dye-donor element contains a colorless, nonpolymeric material for increasing dye transfer efficiency having the following formula:

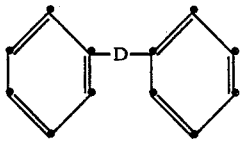

wherein D is —CO—, $-SO_2NR-$, —CONR—, —CO—CHR—CO—,

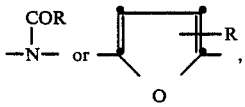

wherein R is H or a substituted or unsubstituted alkyl group having from 1 to about 6 carbon atoms.

2. The element of claim 1 wherein said polymeric binder comprises cellulose acetate propionate or cellulose acetate butyrate.

3. The element of claim 1 wherein D is —CO—CHR—CO—, wherein R is hydrogen.

4. The element of claim 1 wherein D is $-SO_2NR-$, wherein R is $-C_2H_5$.

5. The element of claim 1 wherein D is —CONR—.

6. The element of claim 5 wherein R is methyl or ethyl.

7. The element of claim 1 wherein said support comprises poly(ethylene terephthalate) and the dye layer comprises sequential repeating areas of cyan, magenta and yellow dye.

8. In a process of forming a dye transfer image comprising imagewise-heating a dye-donor element comprising a support having on one side thereof a dye layer comprising a dye dispersed in a polymeric binder and transferring a dye image to a dye-receiving element to form said dye transfer image, the improvement wherein said dye-donor element contains a colorless, nonpolymeric material for increasing dye transfer efficiency having the following formula:

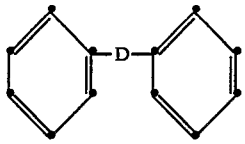

wherein D is —CO—, —$SO_2$NR—, —CONR—, —C—CHR—CO—,

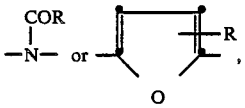

wherein R is H or a substituted or unsubstituted alkyl group having from 1 to about 6 carbon atoms.

9. The process of claim 8 wherein said polymeric binder comprises cellulose acetate propionate or cellulose acetate butyrate.

10. The process of claim 8 wherein D is —CO—CHR—CO—, wherein R is hydrogen.

11. The process of claim 8 wherein D is —$SO_2$NR—, wherein R is —$C_2H_5$.

12. The process of claim 8 wherein D is —CONR—.

13. The process of claim 12 wherein R is methyl or ethyl.

14. The process of claim 8 wherein said support is poly(ethylene terephthalate) which is coated with sequential repeating areas of cyan, magenta and yellow dye and said process steps are sequentially performed for each color to obtain a three-color dye transfer image.

15. In a thermal dye transfer assemblage comprising:

(a) a dye-donor element comprising a support having on one side thereof a dye layer comprising a dye dispersed in a polymeric binder, and (b) a dye-receiving element comprising a support having thereon a dye image-receiving layer, said dye-receiving element being in a superposed relationship with said dye-donor element so that said dye layer is in contact with said dye image-receiving layer, the improvement wherein said dye-donor element contains a colorless, nonpolymeric material for increasing dye transfer efficiency having the following formula:

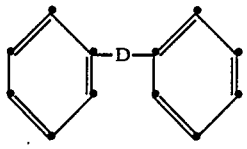

wherein D is —CO—, —$SO_2$NR—, —CONR—, —CO—CHR—CO—,

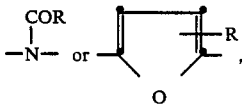

wherein R is H or a substituted or unsubstituted alkyl group having from 1 to about 6 carbon atoms.

16. The assemblage of claim 15 wherein said polymeric binder comprises cellulose acetate propionate or cellulose acetate butyrate.

17. The assemblage of claim 15 wherein D is —CO—CHR—CO—, wherein R is hydrogen.

18. The assemblage of claim 15 wherein D is —$SO_2$NR—, wherein R is —$C_2H_5$.

19. The assemblage of claim 15 wherein D is —CONR—.

20. The assemblage of claim 19 wherein R is methyl or ethyl.

* * * * *